US006568317B1

(12) United States Patent
Fischer

(10) Patent No.: US 6,568,317 B1
(45) Date of Patent: May 27, 2003

(54) TENSIONING UNIT

(75) Inventor: Charles Fischer, Wohlen (CH)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/548,353

(22) Filed: Apr. 12, 2000

(30) Foreign Application Priority Data

May 5, 1999 (DE) ..... 199 20 725

(51) Int. Cl.[7] ..... B65B 13/22
(52) U.S. Cl. ..... 100/32; 53/589
(58) Field of Search ..... 100/26, 29, 32, 100/25, 33 PB, 589; 53/589, 582

(56) References Cited

U.S. PATENT DOCUMENTS

| | | | | | |
|---|---|---|---|---|---|
| 3,179,037 | A | * | 4/1965 | Cranston, Jr. et al. | 100/14 |
| 4,011,808 | A | * | 3/1977 | Aoki et al. | 100/26 |
| 4,575,994 | A | * | 3/1986 | Takami | 53/582 |
| 4,724,659 | A | * | 2/1988 | Mori et al. | 53/589 |
| 4,885,901 | A | * | 12/1989 | Sakaki et al. | 53/589 |
| 4,912,908 | A | * | 4/1990 | Sakaki | 53/589 |
| 4,955,180 | A | * | 9/1990 | Sakaki et al. | 53/399 |
| 5,442,899 | A | * | 8/1995 | Shibazaki et al. | 53/589 |
| 5,577,371 | A | * | 11/1996 | Lang | 53/589 |
| 5,613,432 | A | | 3/1997 | Hoshino | 100/26 |
| 5,615,538 | A | * | 4/1997 | Miyashita et al. | 53/589 |
| 6,035,774 | A | | 3/2000 | Fischer | 100/32 |

FOREIGN PATENT DOCUMENTS

| | | |
|---|---|---|
| DE | 1157538 | 11/1963 |
| DE | 43 16 907 A1 | 12/1993 |
| DE | 196 52 103 A1 | 6/1998 |
| EP | 0 223 988 | 6/1987 |
| FR | 1176752 | 4/1959 |

* cited by examiner

*Primary Examiner*—Rinaldi I. Rada
*Assistant Examiner*—Louis Tran
(74) *Attorney, Agent, or Firm*—Oliff & Berridge PLC

(57) ABSTRACT

A tensioning unit for a strapping machine serves for tensioning and sealing a band guided around an item to be strapped. It has a tensioning head and housing. The tensioning head includes a tensioning device and clamping and sealing subassembly. Toward the end of a tensioning operation, the head can be displaced relative to the housing in a band-running direction, counter to tensioning direction. Also provided in the housing is a band guide arranged downstream of the clamping and sealing member, in the band-running direction, subdivided into front and rear band-guide parts. In this case, only the front band-guide part can be displaced, together with the tensioning head, relative to the housing, whereas the rear band-guide is moved transversely to the band-running direction by the front band-guide part, which is moved in the band-running direction B, counter to a spring force.

15 Claims, 6 Drawing Sheets

TENSIONING UNIT

FIELD OF INVENTION

The invention relates to a tensioning unit for a strapping machine for the tensioning and sealing of a band guided around an item which is to be strapped. The tensioning unit has a tensioning head and a housing accommodating the same. The tensioning head includes a tensioning device and a clamping and sealing subassembly. Toward the end of a respective tensioning operation, the tensioning head can be displaced relative to the housing in a band-running direction, counter to the tensioning direction. Provided in the housing is a band guide which is arranged downstream of the clamping and sealing member, as seen in the band-running direction.

SUMMARY OF THE INVENTION

By means of such a tensioning unit, the band is usually first of all introduced into a curved guide path element of the strapping machine and thus guided around the respective item which is to be strapped. The band end is then clamped firmly by means of the clamping and sealing member. Before the band is tensioned by the tensioning device, band guides provided are moved back to release the band. The band is then tensioned by the tensioning device. Friction forces occur at the different corners of the item around which the band is guided. A decrease in the band tensioning, is caused on account of this friction, from corner to corner of the item which is to be strapped. Thus, toward the end of the tensioning operation, the tensioning head is displaced, relative to the housing accommodating said tensioning head, in a band-running direction, counter to the tensioning direction, in order to ensure that the tensioning is regulated correspondingly. In this case, the item which is to be strapped is secured in relation to the housing, for which purpose the housing may be connected, for example, firmly to the curved guide path element of the strapping machine.

In the case of conventional tensioning units, it is not just the band guide which is arranged downstream of the clamping and sealing member, as seen in the band-running direction. The entire rear band guide is correspondingly displaced in the band-running direction, with the tensioning head, relative to the housing.

Since, the entire rear band guide is correspondingly displaced and has to leave enough space in order to be able to pass out of the housing, the housing has to be provided with a corresponding through-passage. For this purpose, corresponding intervention in the curved band-guide path element, which adjoins the housing, is also necessary.

An object of the invention is to provide a tensioning unit in which it is possible to dispense with the through-passages in the housing and which can thus be installed without any intervention in the adjacent components being necessary.

This object is achieved according to the invention in that the band guide, which is arranged downstream of the clamping and sealing member, is subdivided into a front and a rear band-guide part. Only the front band-guide part can be displaced, together with the tensioning head, relative to the housing. The rear band-guide part can be moved away generally transversely to the band-running direction by the front band-guide part, when the latter is moved in the band-running direction, preferably counter to a spring force.

With a respective displacement of the tensioning head, the rear band-guide part is thus displaced away within the housing, generally transversely to the band-running direction, by the front band-guide part. As a result, enough space is provided within the housing for the movement of the front band-guide part. The rear band-guide part does not move along with the tensioning head in the band-running direction. Thus, there is no longer any need for any through-passages in the housing. The tensioning unit can be installed in the relevant strapping machine without any intervention in the adjacent components. This is advantageous, in particular, for installation in existing machines.

The front and the rear band-guide parts may be provided with interacting sloping surfaces via which the rear band-guide part is correspondingly displaced away. If the tensioning head, and the front band-guide part, are displaced in the band-running direction, then the rear band-guide part slides, by way of its sloping surface, along the sloping surface of the front band-guide part. For example, in the outward direction, as a result of which a corresponding amount of space is provided for the front band-guide part.

In one exemplary embodiment of the tensioning unit according to the invention, the rear band-guide part is mounted such that it can be pivoted about an inner spindle, supported on the housing. The rear-band guide part is forced into its band-guiding position by a spring force. If the band is to be released for the tensioning operation, then the rear band-guide part can be correspondingly deflected counter to the spring force. If, toward the end of the tensioning operation, the tensioning head is then displaced in the band-running direction, the rear band-guide part can additionally be deflected counter to the spring force in order to provide enough space for the front band-guide part. The relevant pivot spindle preferably extends generally parallel to the band-running direction.

The rear band-guide part, which is preferably arranged at a free end of a pivot lever, may be provided with a band-guide slit. As soon as said band-guide part is pivoted out of its band-guiding position, the band can pass out of the guide slit.

In one exemplary embodiment of the tensioning unit according to the invention, the front band-guide part can be driven for a respective release of the band. The rear band-guide part is correspondingly carried along by the front band-guide part. The rear band-guide part thus already has the front band-guide part correspondingly acting on it for a respective band release.

It is possible for the front band-guide part to be mounted such that it can be pivoted. For example, about a spindle, and to be forced into its band-guiding position by a spring force. Once again, it is expedient for the pivot spindle generally to extend parallel to the band-running direction.

The front band-guide, part, may be preferably arranged at a free end of a pivot lever with a band-guide slit. The latter is aligned with the guide slit of the rear band-guide part. If the rear band-guide part is carried along, for example, by the front band-guide part for a respective release of the band, and is correspondingly pivoted with said front band-guide part, then the band is released simultaneously from both slits.

In one exemplary embodiment of the tensioning unit according to the invention, the front band-guide part, which is provided with a band-guide slit, is arranged at a free end of a two-armed pivot lever. At the other free end is provided a follow-on roller interacting with a cam plate. In this case, it is possible for the pivot lever to be forced into the band-guiding position by a spring force.

It is customary for the tensioning head also to comprise a band guide which is arranged upstream of the clamping and sealing member, as seen in the band-running direction. Such a front band guide may then be moved out of its band-guiding position again for a respective release of the band.

The invention is explained in more detail hereinbelow, by way of an exemplary embodiment, with reference to the drawings.

DETAILED DESCRIPTION OF PREFERRED EMBODIMENTS

Figure 1:
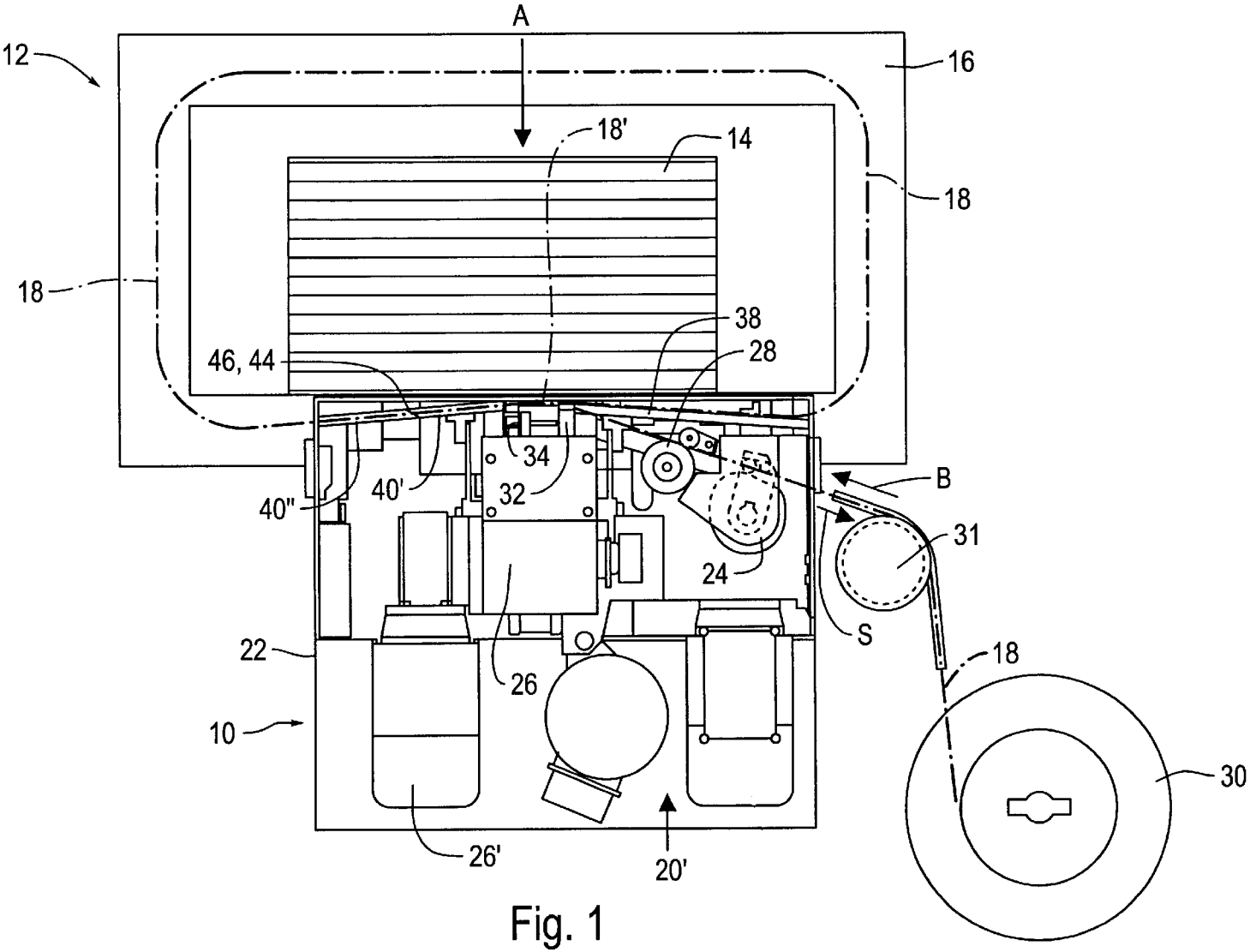
FIG. 1 shows a schematic side view of a strapping machine provided with a tensioning unit according to one exemplary embodiment of the invention.

FIG. 1 shows a purely schematic side view of a strapping machine 12 which is provided with a tensioning unit 10 according to the invention and has a curved guide path element 16 surrounding the respective item which is to be strapped 14.

The tensioning unit serves for tensioning and sealing of a band 18, for example, a plastic band, which is guided around the item which is to be strapped 14. The tensioning unit 10 has a tensioning head 20 and a housing 22 which accommodates the same. The housing 22 is supported on the curved guide path element 16. The item which is to be strapped 14, and is surrounded by the curved guide path element 16, is secured in its position in relation to the housing 22 of the tensioning unit 10.

The tensioning head 20 includes a tensioning device 24 and a clamping and sealing subassembly 26. In this case, the tensioning device 24 serves, in particular, for the final tensioning of the band 18. The tensioning device has a drive motor (not shown). Arranged between the tensioning device 24 and the clamping and sealing subassembly 26 is a pair of conveying rollers 28 connected to a reversible drive. The clamping and sealing subassembly has a drive motor 26'. The band 18, which is fed from an unwinding device 30 via a band-guide unit 31, is guided through the tensioning device 24. The band 18 is intended to be fed by the pair of conveying rollers 28 in a band-running direction B, which is counter to the tensioning direction S, through the clamping and sealing subassembly 26 and into the curved guide path element 16. The free band end 18 is in front, and the band is fed until the band end 18' butts against a stop in the clamping and sealing subassembly 26. The curved guide path element 16 runs around the item which is to be strapped 14. The band 18, which is guided around the item which is to be strapped 14 and is clamped firmly, by means of a first band clamp 32 of the clamping and sealing subassembly 26, at a distance from the band end 18' butting against said stop. The band 18 is also intended to be drawn back in the tensioning direction S by means of the pair of conveying rollers 28 until it is positioned at least essentially on the item which is to be strapped 14.

The clamping and sealing subassembly 26 has a second band clamp 34. Between the two band clamps 32, 34, a welding unit 36 (see in particular, FIGS. 2 to 4), which may be provided, for example, with a welding tongue or the like.

Once the pair of conveying rollers has drawn back the band 18 in the tensioning direction S and said band has positioned itself on the item which is to be strapped 14, the tensioning device 24 comes into operation . As a result the band 18 is gripped and tensioned to the predetermined tensioning force.

Figure 9:
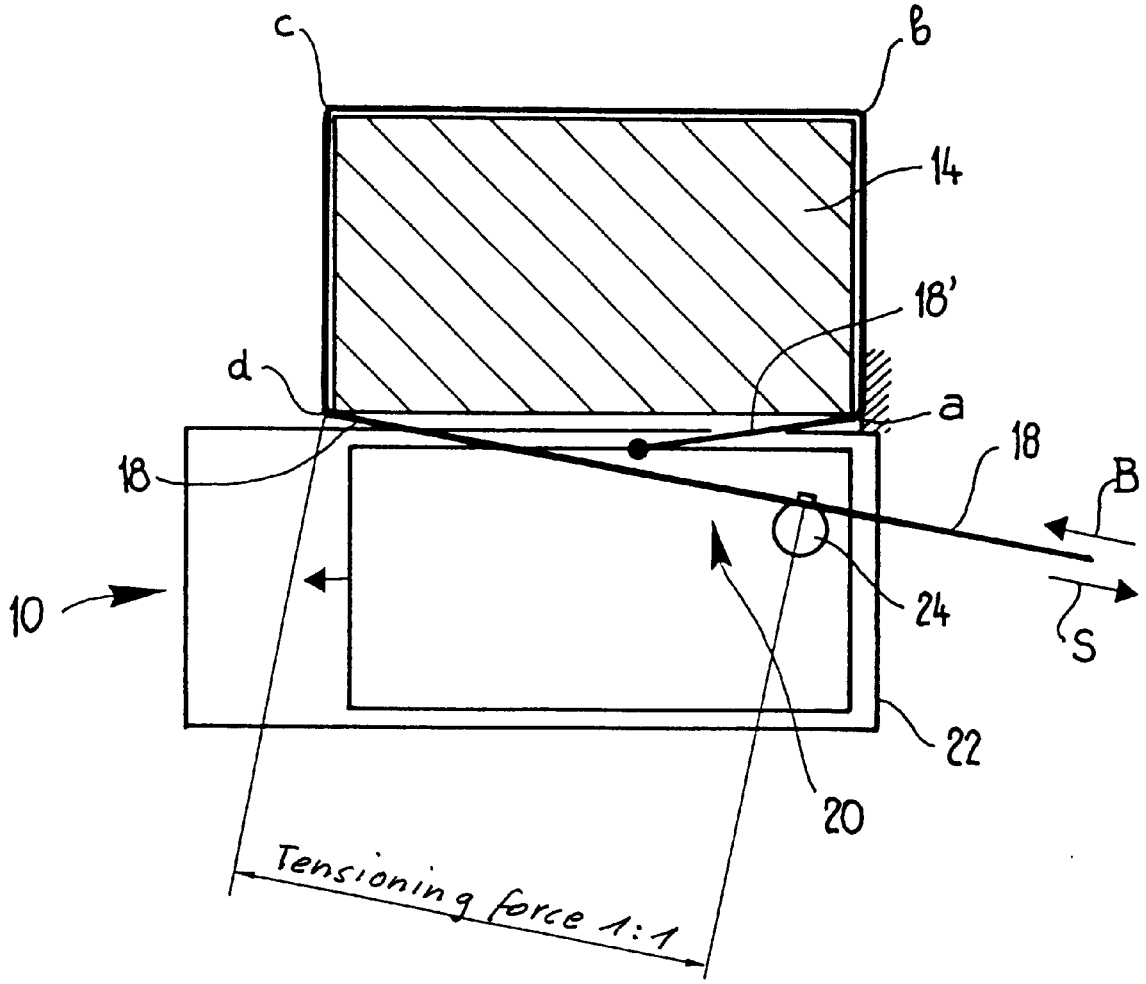
FIG. 9 shows a schematic diagram of the functioning of the tensioning unit during the tensioning operation.

As shown in FIG. 9, the tensioning of the band 18 causes friction to arise at each corner of the item which is to be strapped 14. The band tensioning decreases from the corner a, via the corners b and c, to the corner d of the item which is to be strapped 14. In order, then, to ensure that the tensioning is regulated correspondingly, toward the end of a respective tensioning operation, the tensioning head 20 is displaced to the left relative to the housing 22 in the band-running direction B, which is counter to the tensioning direction S, with the band end 18' clamped firmly. In this case, the tensioning head 20 is guided by the housing-mounted guides 37 as shown in FIGS. 2 to 4.

Following this, the clamping and sealing subassembly 26 comes into operation. The second band clamp 34 clamps the band 18 firmly and the welding unit 36 (see FIGS. 2 to 4) welding the two overlapping sections of the band 18 to one another by heating and clamping. Thereafter, the band 18 is severed downstream of the welding location, as seen in the tensioning direction S the clamping and sealing subassembly 26.

Figure 2:
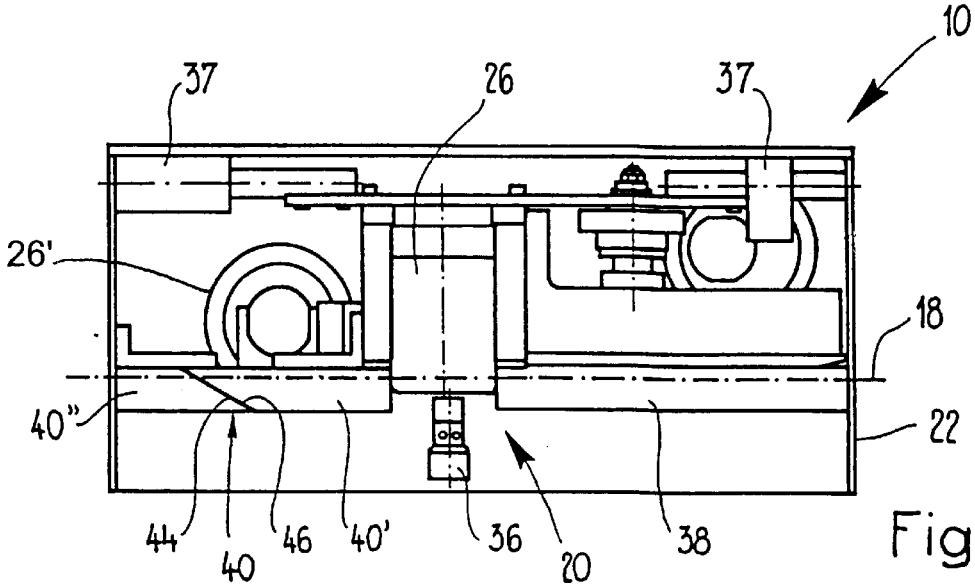
FIG. 2 shows a schematic plan view of the tensioning unit in which the tensioning head is illustrated in its starting position and the band guides are each in their band-guiding position.
Figure 3:
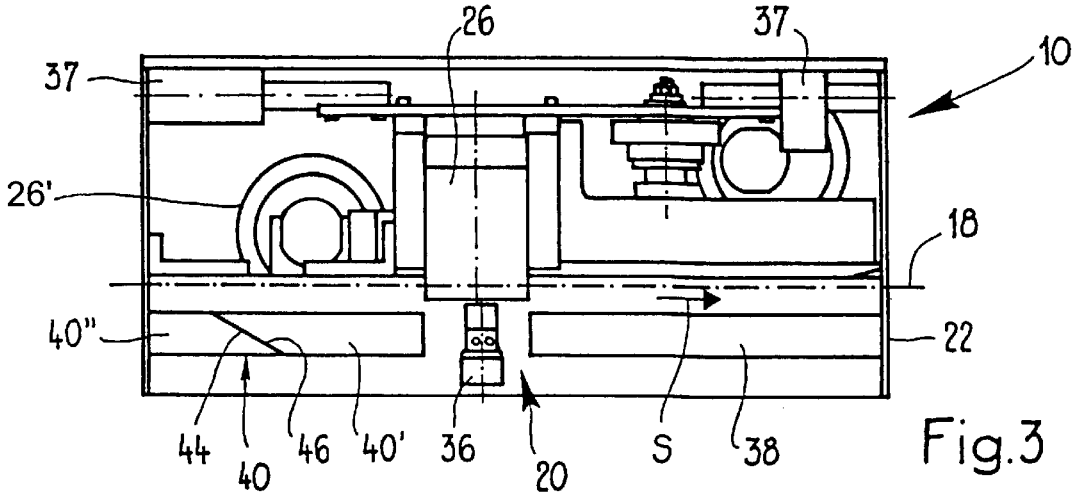
FIG. 3 shows a schematic plan view of the tensioning unit in which the tensioning head is still in its starting position, but the band guides have already been moved out of their respective band-guiding position.
Figure 4:
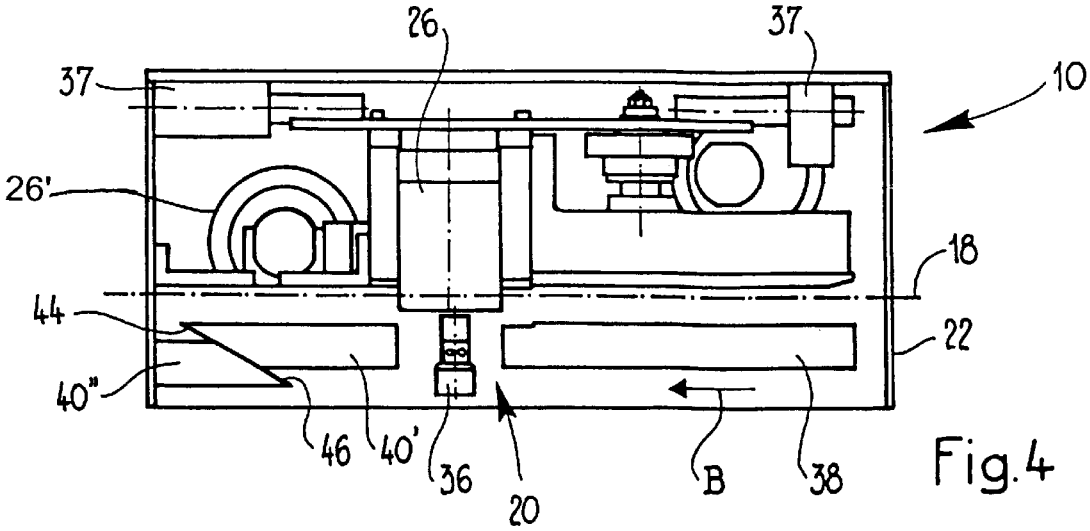
FIG. 4 shows a schematic plan view of the tensioning unit in which the tensioning head has already been moved out of its starting position in the band-running direction, which is counter to the tensioning direction, and the rear band-guide part has correspondingly also been displaced away in the outward direction by the front band-guide part of the rear band guide.

As can be seen, in particular, from FIGS. 2 to 4, the tensioning head 20 comprises a band guide 38 arranged upstream of the clamping and sealing member 26, as seen in the band-running direction B, and can be displaced together with the tensioning head 20, relative to the housing 22.

Also provided in the housing 22 is a band guide 40 arranged downstream of the clamping and sealing member 26, as seen in the band-running direction B.

As shown in FIGS. 2 to 4, the band guide 40, arranged downstream of the clamping and sealing member 26, is subdivided into a front and rear band-guide part 40' and 40", respectively, as seen in the band-running direction B. In this case, only the front band-guide part 40' can be displaced, together with the tensioning head 20 relative to the housing 22.

In contrast, the rear band-guide part 40" is displaced away transversely to the band-running direction B and counter to the force of a restoring spring 42 (shown in FIG. 7) by the front band-guide part 40', which is moved in the band-running direction B (as shown in FIG. 4). As can be seen from FIG. 4, the rear band-guide part 40" is displaced away in this manner once the band 18 has already been released. This means that the rear band-guide part 40" is moved even further outward, as shown in FIG. 4, by respective displacement of the tensioning head 20 than has already been the case with the preceding release of the band 18.

Figure 10A:
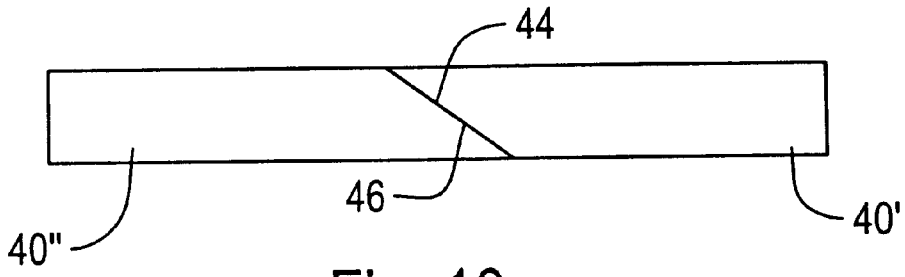
FIGS. 10(*a*)–10(*c*) show a detail of the relation between the front band-guide part and the rear band-guide part.
Figure 10B:
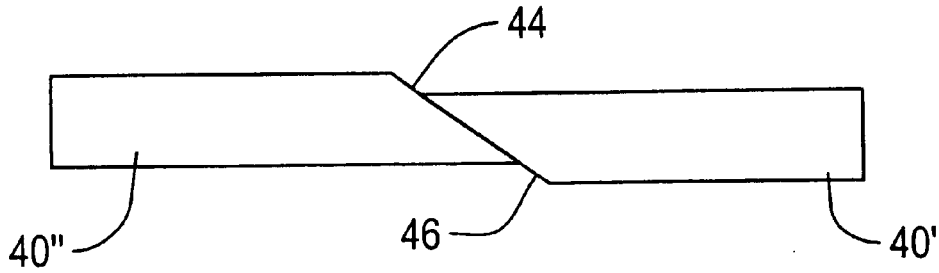
Figure 10C:
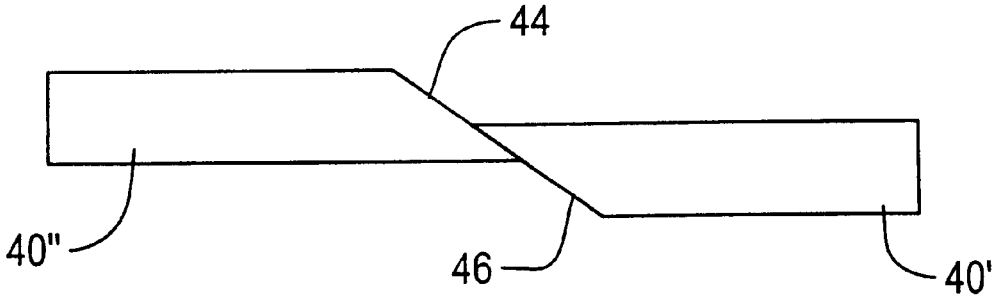

The essential factor is thus that the rear band-guide part 40" is displaced transversely to the band-running direction B relative to the front band-guide part 40', with the result that enough space for the movement of the front band-guide part 40' is provided within the housing 22. See FIGS.10(*a*)–10(*c*). The rear band-guide part 40" thus does not move along the tensioning head 20 in the band-running direction B. Accordingly, there is also no longer any need for any through-passages in the housing 22. The tensioning unit 10 can be installed in the strapping machine 12 without any intervention in the adjacent components, for example the curved guide path element 16, being necessary. This is advantageous, in particular, for installation in existing machines.

In the present case, the front and the rear band-guide parts 40' and 41', respectively, are provided with interacting sloping surfaces 44, 46 via which the rear band-guide part 40" is correspondingly displaced outward in the manner illustrated in FIG. 4. The sloping surfaces 44, 46 are inclined with respect to the band running direction B.

Figure 8:
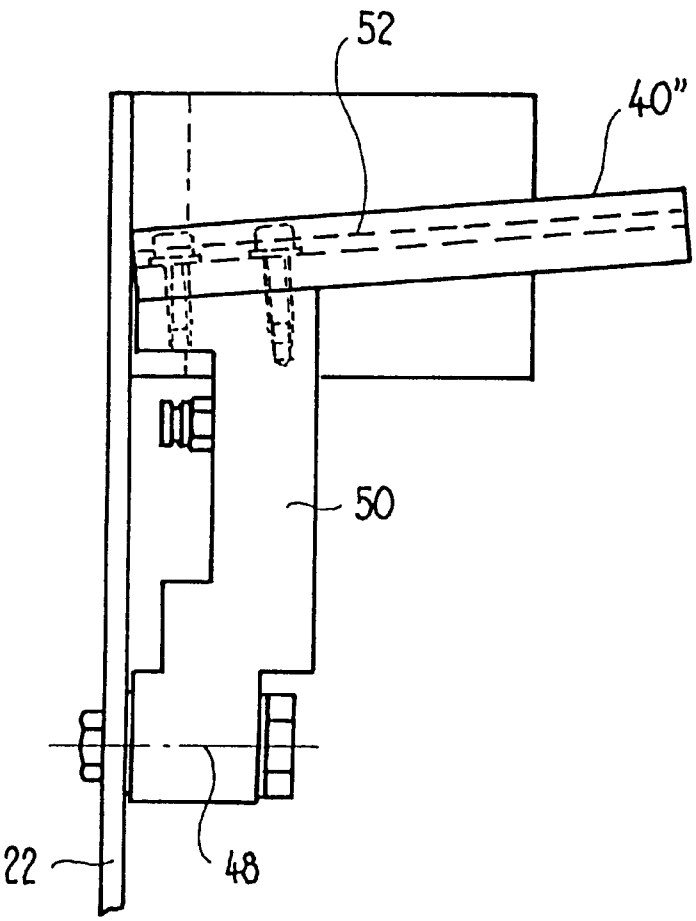
FIG. 8 shows a schematic front view of the rear band-guide part.
Figure 7:
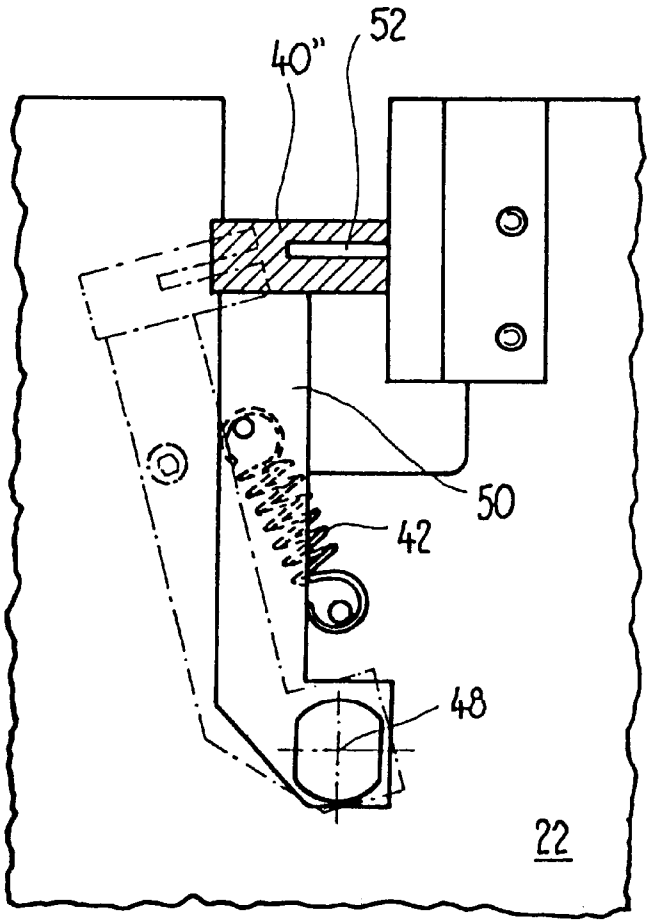
FIG. 7 shows a schematic side view of the rear band-guide part assigned to the rear band guide; as seen in the band-running direction.

In the present exemplary embodiment, the rear band-guide part 40" is mounted such that it can be pivoted about an inner spindle 48, which is supported on the housing 22 and generally extends parallel to the band-running direction B (see, in particular, FIGS. 7 and 8). In this case, said rear band-guide part 40", is arranged at the free end of a pivot lever 50, and is provided with a band-guide slit 52. The restoring spring 42 is arranged between the housing 22 and the pivot lever 50. Said restoring spring 42 forces the pivot lever 50 into the band-guiding position, in which the band 18 is accommodated in the guide slit 52. As can be seen from FIG. 7, the rear band-guide part 40" can then be correspondingly pivoted counter to the force of the restoring spring 42 in order to release the band 18 and/or, furthermore, in order to release the displacement path for the front band-guide part 40'.

The front band-guide part 40' can be driven for a respective release of the band 18, whereas the rear band-guide part 40" is correspondingly carried along by the front band-guide part 40' (see, in particular, FIGS. 2 and 3).

Figure 6:
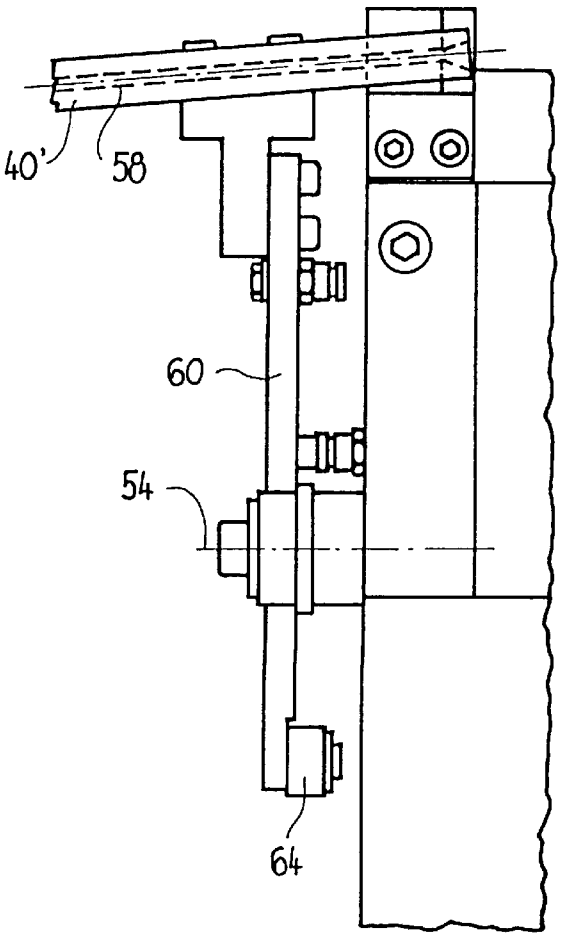
FIG. 6 shows a schematic front view of the front band-guide part.
Figure 5:
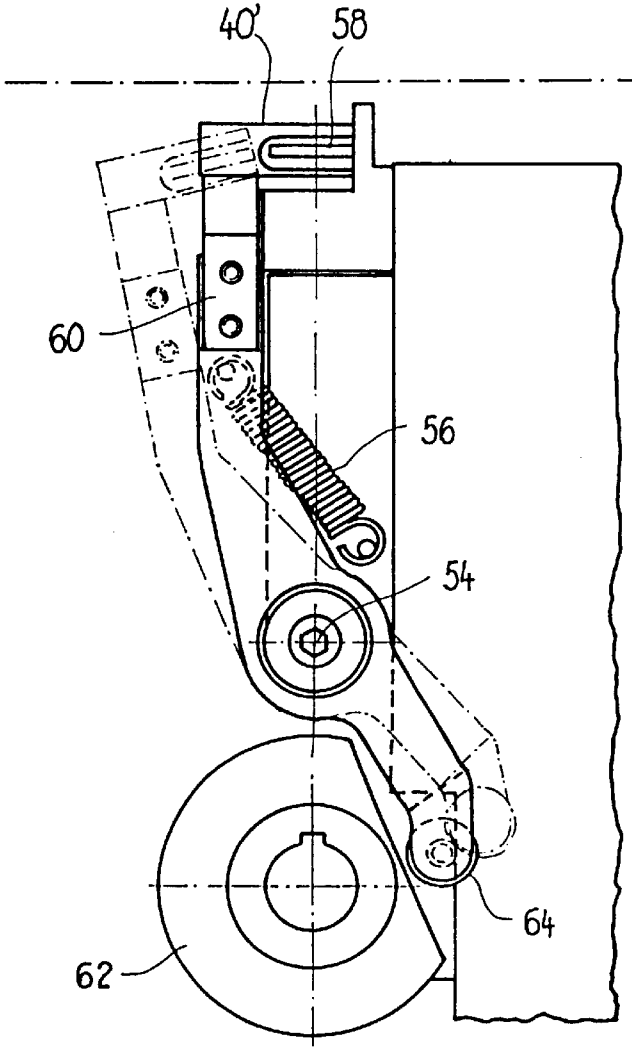
FIG. 5 shows a schematic side view of the front band-guide part assigned to the rear band guide, as seen in the band-running direction.

As can best be seen from FIGS. 5 and 6, the front band-guide part 40' is mounted such that it can be pivoted about a spindle 54 and is forced into its band-guiding position by the force of a restoring spring 56. The pivot spindle 54 runs, once again, generally parallel to the band-running direction B.

In the present exemplary embodiment, the front band-guide part 40', which is provided with a band-guide slit 58, is arranged at a free end of a two-armed pivot lever 60. At the other free end there is provided a follow-on roller 64 interacting with a cam plate 62 (see, in particular, FIGS. 5 and 6).

For a respective release of the band 18, the pivot lever 60 is thus correspondingly pivoted via the cam plate 62, whereupon the band 18 passes out of the guide slit 58 of the front band-guide part 40', which is assigned to said pivot lever 60. The rear band-guide part 40" is carried along by the front band-guide part 40', with the result that, as the front band-guide part 40' is pivoted out of the band-guiding position, the rear band-guide part 40" is correspondingly pivoted as well and, at the same time, the band 18 also passes out of the band-guide slit 52 of said rear band-guide part 40".

The front band guide 38 may also be moved out of its band-guiding position for a respective release of the band 18.

What is claimed is:

1. A tensioning unit for a strapping machine for the tensioning and sealing of a band guided around an item which is to be strapped, comprising:

a tensioning head;

a housing accommodating the tensioning head, the tensioning head including a tensioning device for tensioning a band in a tensioning direction during a tensioning operation, and a clamping and sealing device for clamping and sealing the band, the tensioning head being mounted for a movement relative to the housing in a band-running direction, which is counter to the tensioning direction, in order to allow a displacement of the tensioning head relative to the housing in the band-running direction toward the end of a respective tensioning operation; and a band guide arranged in the housing downstream of the clamping and sealing member as seen in the band-running direction, the band guide being subdivided into a front band-guide part and a rear band-guide part, the front band-guide part being displaceable together with the tensioning head relative to the housing in the band-running direction, and the rear band-guide part being moveable away transversely to the band-running direction by the front band-guide part when in contact with the front band-guide part and when the latter is moved in the band-running direction.

2. The tensioning unit as claimed in claim 1, wherein the rear band-guide part being moveable away transversely to the band-running direction counter to the force of a spring.

3. The tensioning unit as claimed in claim 1, wherein the front and the rear band-guide parts are provided with interacting sloping surfaces through which the rear band-guide part is displaced away transversely to the band-running direction.

4. The tensioning unit as claimed in claim 2, wherein the rear band-guide part is pivotably mounted about a spindle supported on the housing and is forced by the spring into a band-guiding position.

5. The tensioning unit as claimed in claim 4, wherein the pivot spindle extends parallel to the band-running direction.

6. The tensioning unit as claimed in claim 1, wherein the rear band-guide part is provided with a band-guide slit.

7. The tensioning unit as claimed in claim 6, wherein the rear band-guide part is arranged at a front end of a pivot lever.

8. The tensioning unit as claimed in claim 1, wherein the front band-guide part is driven for a release of the band, and the rear band-guide part is correspondingly taken along by the front band-guide part.

9. The tensioning unit as claimed in claim 1, wherein the front band-guide part is pivotably mounted about a spindle and is forced into a band-guiding position by the force of a spring.

10. The tensioning unit as claimed in claim 9, wherein the pivot spindle extends parallel to the band-running direction.

11. The tensioning unit as claimed in claim 1, wherein the front band-guide part is provided with a band-guide slit.

12. The tensioning unit as claimed in claim 11, wherein the front band-guide part is arranged at a free end of a pivot lever.

13. The tensioning unit as claimed in claim 12, wherein the front band-guide part is arranged at a free end of a two-armed pivot lever, an other free end of which carries a follow-on roller interacting with a cam plate.

14. The tensioning unit as claimed in claim 1, wherein the tensioning head further comprises a band guide which is arranged upstream of the clamping and sealing member, as seen in the band-running direction.

15. The tensioning unit as claimed in claim 14, wherein the front band guide is moveable out of a band-guiding position for a release of the band.

* * * * *